US010208597B2

(12) United States Patent
Lenaburg

(10) Patent No.: US 10,208,597 B2
(45) Date of Patent: Feb. 19, 2019

(54) CUTTER DISC WITH SET BACK TEETH FOR TUNNEL BORING MACHINE

(71) Applicant: The Robbins Company, Solon, OH (US)

(72) Inventor: Carl E. Lenaburg, Tacoma, WA (US)

(73) Assignee: The Robbins Company, Solon, OH (US)

( * ) Notice: Subject to any disclaimer, the term of this patent is extended or adjusted under 35 U.S.C. 154(b) by 80 days.

(21) Appl. No.: 15/337,764

(22) Filed: Oct. 28, 2016

(65) Prior Publication Data

US 2017/0130579 A1 May 11, 2017

Related U.S. Application Data

(60) Provisional application No. 62/253,614, filed on Nov. 10, 2015.

(51) Int. Cl.
*E21D 9/10* (2006.01)

(52) U.S. Cl.
CPC ..... *E21D 9/104* (2013.01); *E21D 9/1006* (2013.01)

(58) Field of Classification Search
CPC ..... E21D 9/1006; E21D 9/104; E21D 9/10
See application file for complete search history.

(56) References Cited

U.S. PATENT DOCUMENTS 2,223,864 A 12/1940 Zublin
2,306,683 A 12/1942 Zublin
4,784,438 A * 11/1988 Fikse ..... E21B 10/12 175/371
5,234,064 A 8/1993 Lenaburg
5,785,135 A * 7/1998 Crawley ..... E21B 10/10 175/373

(Continued)

FOREIGN PATENT DOCUMENTS

JP 11229742 A * 8/1999
JP 3722885 B2 11/2005

(Continued)

OTHER PUBLICATIONS

English language machine translation of Nishiyama, Japanese Patent Publication No. 11-229742, published Aug. 24, 1999 (6 pages) (Year: 1999).*

(Continued)

*Primary Examiner* — Janine M Kreck
*Assistant Examiner* — Michael A Goodwin
(74) *Attorney, Agent, or Firm* — Christensen O'Connor Johnson Kindness, PLLC; Ryan E. Dodge, Jr.

(57) ABSTRACT

A cutter disc for a tunnel boring machine includes a middle disc portion defining a radially outer surface or edge for engaging a surface, a left toothed portion defining a first set of teeth set back from the outer edge, and a right toothed portion defining a second set of teeth set back from the outer edge. In an embodiment, a central bore through the cutter disc is configured to attach the cutter disc to a hub for rotatably mounting the cutter disc on a shaft. In an embodiment, the hub is formed integrally with the cutter disc. The left and right toothed portions provide structural support to the middle portion and facilitate rotation of the cutter disc when boring in soft or mixed conditions, but do not interfere with boring in hard rock conditions.

20 Claims, 10 Drawing Sheets

(56) References Cited

U.S. PATENT DOCUMENTS

| | | | | |
|---|---|---|---|---|
| 5,904,211 | A | 5/1999 | Friant et al. | |
| 6,367,569 | B1 | 4/2002 | Walk | |
| 7,017,683 | B2 | 3/2006 | Narvestad | |
| 7,401,537 | B1 * | 7/2008 | Krauter | B23K 26/34 148/903 |
| 7,997,659 | B2 | 8/2011 | Oertley et al. | |
| 8,783,786 | B2 | 7/2014 | Shanahan et al. | |
| 2009/0079256 | A1 | 3/2009 | Oertley et al. | |
| 2012/0212034 | A1 | 8/2012 | Shanahan et al. | |
| 2014/0251696 | A1 | 9/2014 | Cox | |
| 2015/0028657 | A1 | 1/2015 | Narvestad | |
| 2016/0298451 | A1 * | 10/2016 | Feistritzer | E21C 25/18 |

FOREIGN PATENT DOCUMENTS

| | | | |
|---|---|---|---|
| JP | 3901330 | B2 | 4/2007 |
| KR | 10-20140049977 | A | 4/2014 |

OTHER PUBLICATIONS

Espallargas, N., et al., "Influence of Corrosion on the Abrasion of Cutter Steels Used in TBM Tunnelling," Rock Mechanics and Rock Engineering 48(1):261-275, Jan. 2015.

International Search Report and Written Opinion dated Feb. 13, 2017, issued in corresponding International Application No. PCT/US2016/059202, filed Oct. 27, 2016, 17 pages.

International Search Report and Written Opinion dated Feb. 15, 2017, issued in corresponding International Application No. PCT/US2016/059433, filed Oct. 28, 2016, 12 pages.

* cited by examiner

CUTTER DISC WITH SET BACK TEETH FOR TUNNEL BORING MACHINE

CROSS-REFERENCE TO RELATED APPLICATION

This application claims the benefit of Provisional Application No. 62/253,614, filed Nov. 10, 2015, the entire disclosure of which is hereby incorporated by reference herein.

BACKGROUND

A tunnel boring machine ("TBM") is a tunnel excavation apparatus that is used to bore through the solid earth or ground (e.g., soil, rock, strata, mixed media, etc.). An exemplary tunnel boring machine is disclosed in U.S. Pat. No. 9,010,872, to Lenaburg, which is hereby incorporated by reference in its entirety.

Typically, a TBM includes a rotating cutterhead having a plurality of cutter assemblies mounted to the cutterhead. The rotating TBM cutterhead is pressed with a large thrust force against the ground or surface to be bored. The cutter assemblies exert local forces on the rock face to induce fracture or other structural failure in the ground substrate. Loosed material is then conveyed away to progressively form the desired tunnel. A conventional TBM produces a smooth circular tunnel wall, typically with minimal collateral disturbance. Prior TBMs used sturdy grinding spikes mounted to the cutterhead. However, the spikes would frequently break, typically requiring costly and dangerous repairs in situ. A breakthrough development by James S. Robbins was the invention of disc cutter assemblies that are rotatably mounted on the cutterhead. Robbins discovered that by replacing grinding spikes with rotatable disc cutter assemblies the reliability and performance of TBMs was significantly improved. Modern TBMs typically use rotatable disc cutter assemblies mounted to the cutterhead. As the cutterhead is pressed against the boring surface and rotated, the rotatable disc cutter assemblies fracture, crush, and loosen materials in the ground, which are then transported away, typically using a conveyor system progressively constructed behind the TBM as it advances.

FIG. 1 is a cross-sectional view of a prior art cutter ring assembly 80 for a tunnel boring machine (TBM), as disclosed in U.S. Pat. No. 8,783,786, to Shanahan et al., which is hereby incorporated by reference in its entirety. The cutter ring assembly 80 includes a shaft 81 that is configured to be fixedly attached to the TBM rotating cutterhead (not shown). An annular cutter ring 82, also referred to as a cutter disc, is positioned on a hub 83 between a retainer ring 84 and a shoulder 83A formed in the hub 83, to form a ring assembly 85, also referred to as a disc assembly.

The ring assembly 85 is rotatably mounted to the shaft 81 with a pair of bearing assemblies, each bearing assembly comprising an inner bearing race 87 fixed to the shaft 81, an outer bearing race 88 fixed to the hub 83, and a plurality of tapered roller bearings 89 rotatably retained between the inner and outer bearing races 87, 88. Oppositely disposed end retainers 90, 91 are provided on either side of the bearing assemblies, and engage the shaft 81 to hold the cutter ring assembly 80 together. During operation, the ring assembly 85 is rotatable about the shaft 81, and the end retainers 90, 91 are fixed to the shaft 81.

A rotary seal group 92 is provided at the interface between each of the end retainers 90, 91 and the ring assembly 85. The rotary seal groups 92 in this assembly 80 are mechanical face seals, also referred to as duo cone seals. The mechanical face seals were developed for protecting equipment working in the most adverse conditions, and comprise a pair of annular metal seal rings 93 and a pair of elastic toric members 94 (e.g., O-rings). The outer metal seal ring 93 engages the associated end retainer 90 or 91 through one toric member 94 and is fixed. The associated inner metal seal ring 93 engages the ring assembly 85 through a second toric member 94 and rotates. The two associated metal seal rings 93 abut to form a moving seal interface. Typically the available interior volume between the end retainers 90, 91 is filled with a lubricant, e.g., oil or grease. The rotary seal groups 92 provide a seal to retain the lubricant and prevent the incursion of dirt that could damage or destroy the bearing assemblies.

During tunnel boring operations the cutter ring 82 is urged against a rock face with sufficient force to crush and then produce fracturing stresses in the rock face. It is desirable that the width of the radially outer surface of the cutter ring 82 be small in order to reduce the contact area and increase the stress concentration produced on the rock face. However, the cutter ring 82 must have sufficient strength to maintain structural integrity under the extreme load conditions typical for TBMs.

It is also important for the ring assembly 85 to rotate during boring operations. The ring assembly 85 relies on frictional forces between the cutter ring 82 and the rock face to rotate the ring assembly 85 during boring operations, (i.e., while the cutterhead is pressed against the rock face and rotated about its own axis). If the cutter ring 82 stops rotating during boring operations, or slows sufficiently such that the cutter ring 82 skids along the rock surface, the cutter ring 82 will wear preferentially in the region engaging the rock face. Moreover, if the cutter ring 82 begins to preferentially wear at a particular location, the worn region will tend to subsequently stall at the worn location, resulting in growth of the worn region, which can eventually result in the effective loss of the cutter ring assembly 80.

TBMs are increasingly used to tunnel in regions that include relatively soft ground conditions. TBMs configured to operate in such conditions are sometimes referred to as earth pressure balance (EPB) machines. In these regions there may be insufficient frictional contact to ensure that the cutter ring 82 rotates on the shaft. Improvements in the cutter ring assembly are needed to avoid or mitigate the loss of cutter assemblies during operation of the tunnel boring machine. It is very expensive to stop TBM operations to replace or repair cutter assemblies.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A cutter disc for a cutter ring assembly for a tunnel boring machine includes: (i) a middle disc portion having a first sidewall, a second sidewall, and a radially outer continuous cutter edge portion joining the first and second sidewalls, (ii) a first annular toothed portion extending from the first sidewall and defining a first plurality of teeth that are set back from the continuous cutter edge portion of the middle disc portion, and (iii) a second annular toothed portion extending from the second sidewall and defining a second plurality of teeth that are set back from the continuous cutter edge portion of the middle disc portion.

In an embodiment the cutter disc is formed completely from a tool steel forging.

In an embodiment the first and second plurality of teeth are triangular.

In an embodiment the first plurality of teeth comprise at least eighteen teeth, which may be spaced apart.

In an embodiment the first and second plurality of teeth define radially outer edges that slope away from the continuous cutter edge portion.

In an embodiment the first and second plurality of teeth are circularly arranges and uniformly spaced, and the second plurality of teeth are rotationally offset from the first plurality of teeth.

In an embodiment the first and second annular toothed portions are thicker than the middle disc portion.

In an embodiment the first and second plurality of teeth are set back from the continuous cutter edge portion by between 5 mm and 25 mm.

In an embodiment the cutter disc includes integral first and second hub portions that extend axially from the annular toothed portions.

In an embodiment the cutter disc includes a circular annular channel that is sized and configured to receive a split locking ring for locking the cutter disc to a cutter assembly hub.

A cutter assembly for a TBM includes a hub, and a cutter disk formed with (i) a middle disc portion having a first sidewall, a second sidewall, and a radially outer continuous cutter edge portion joining the first sidewall and the second sidewall, (ii) a first annular toothed portion extending from the first sidewall and defining a first plurality of teeth that are set back from the continuous cutter edge portion of the middle disc portion, and (iii) a second annular toothed portion extending from the second sidewall and defining a second plurality of teeth that are set back from the continuous cutter edge portion of the middle disc portion, and mounted on the hub. A bearing assembly is mounted in the hub, and rotatably mounts the hub to a fixed shaft. End retainers are fixed to the shaft and enclose the bearing assembly there between, with rotary seal groups engaging the respective hubs and retainers.

In an embodiment the cutter disc is formed completely from a tool steel forging.

In an embodiment the first and second plurality of teeth are triangular.

In an embodiment the first plurality of teeth comprise at least eighteen teeth, which may be spaced apart.

In an embodiment the first and second plurality of teeth define radially outer edges that slope away from the continuous cutter edge portion.

In an embodiment the first and second plurality of teeth are circularly arranges and uniformly spaced, and the second plurality of teeth are rotationally offset from the first plurality of teeth.

In an embodiment the first and second annular toothed portions are thicker than the middle disc portion.

In an embodiment the first and second plurality of teeth are set back from the continuous cutter edge portion by between 5 mm and 25 mm.

In an embodiment the cutter disc includes integral first and second hub portions that extend axially from the annular toothed portions.

In an embodiment the cutter disc includes a circular annular channel that is sized and configured to receive a split locking ring for locking the cutter disc to a cutter assembly hub.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A first embodiment of a cutter disc 100 in accordance with the present invention is shown in various views in FIGS. 2-5A. The cutter disc 100 provides advantages for all tunnel boring conditions, including hard rock conditions, soft soil conditions, compacted or hardpan conditions, and mixed ground conditions. The cutter disc 100 provides a variable traction operation that is particularly suited to providing superior grip characteristics when operating in tough, variable-geology conditions, for example with so-called earth pressure balance (EPB) TBMs.

Figure 2:
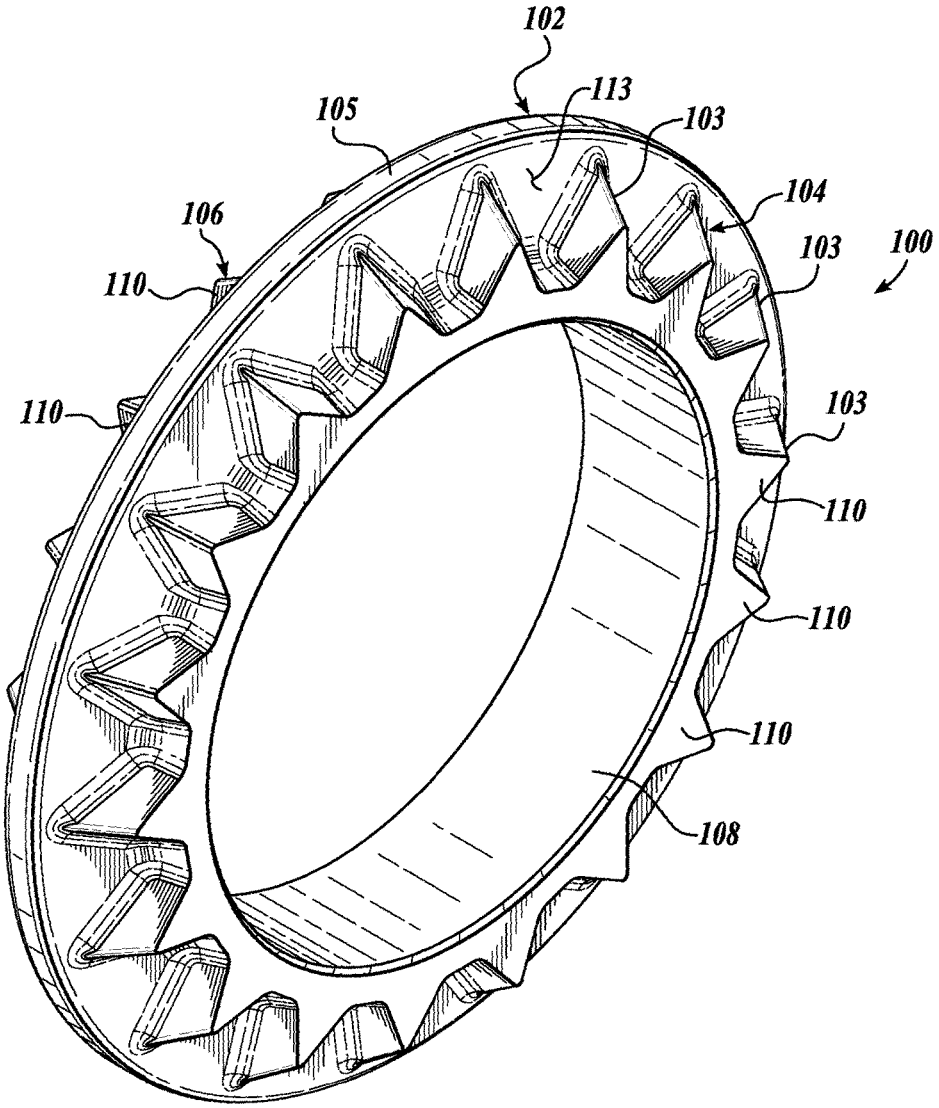
FIG. 2 is a front-right perspective view of a cutter disc with set back teeth in accordance with a first embodiment of the present invention.
Figure 3:
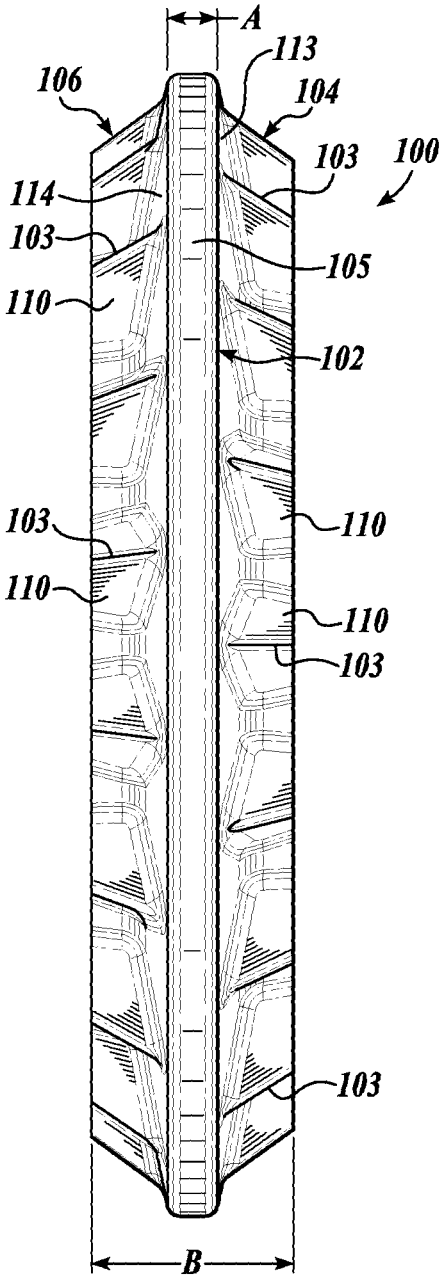
FIG. 3 is a front view of the cutter disc shown in FIG. 2.
Figure 4:
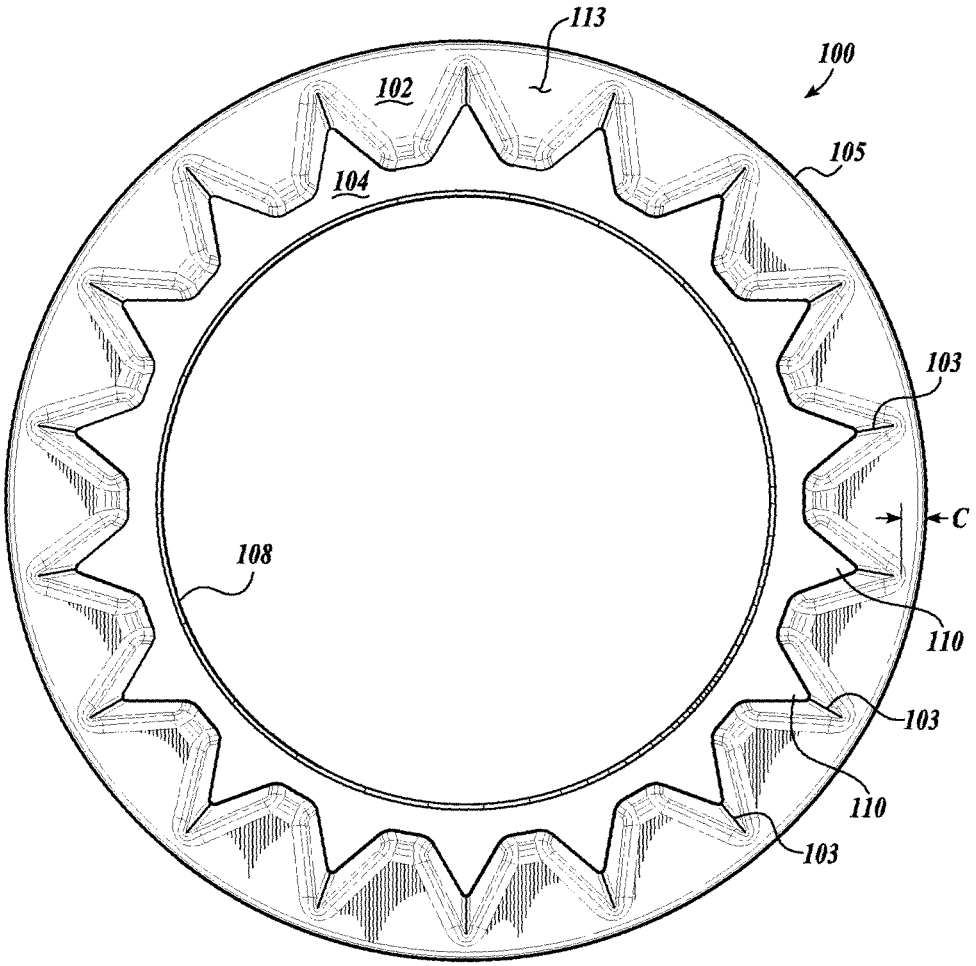
FIG. 4 is a right side view of the cutter disc shown in FIG. 2.
Figure 5A:
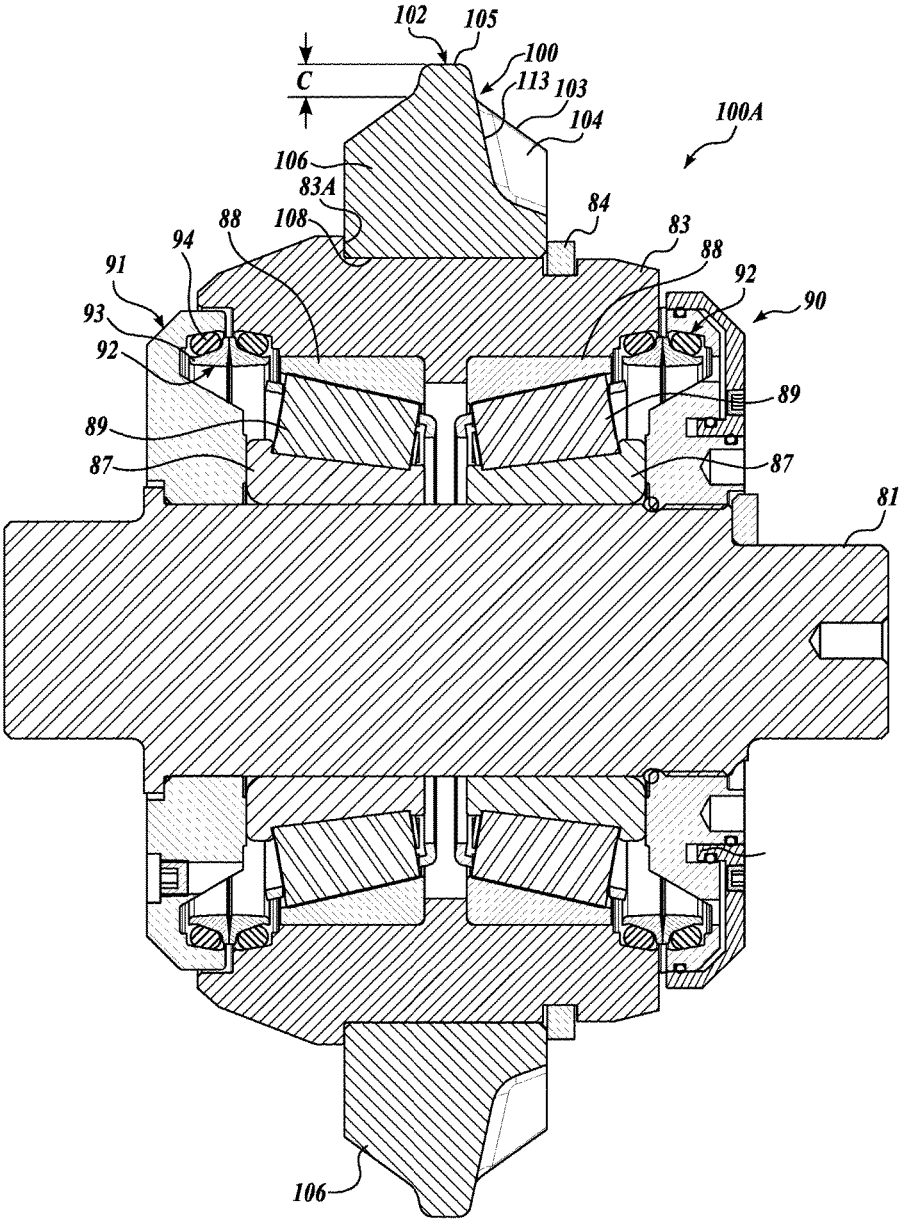
FIG. 5A is a front sectional view of a cutter ring assembly with the cutter disc shown in FIG. 2 fixed to a cutter ring assembly hub.

FIG. 2 is a front-right perspective view of the cutter disc 100. FIGS. 3 and 4 illustrate front and right side views of the cutter disc 100. FIG. 5A shows a sectional view of a cutter ring assembly 100A that includes the cutter disc 100 shown in FIG. 2.

The cutter disc 100 includes three integral portions, a middle disc portion 102 having sidewalls 113,114 that are joined by a radially outer cutter surface or edge 105, a right-side toothed or spoked portion 104 extending from the sidewall 113 on one side of the middle disc portion 102, and a left-side toothed or spoked portion 106 extending from the sidewall 114 on the other side of the middle disc portion 102. A circular inner surface 108 is configured for mounting the cutter disc 100 to a rotatable hub, for example hub 83 (see FIG. 5A).

In this embodiment each of the toothed portions 104, 106 define eighteen triangular teeth 110 that are optionally spaced apart. More or fewer teeth 110 are contemplated. The number of teeth 110 may be selected to the needs of particular applications, for example, to accommodate a particular cutter disc 100 diameter, to optimize performance based on the ground conditions the cutter disc 100 is intended to encounter, to accommodate the operating parameters of a particular TBM, such as cutterhead rotational speed and/or face pressure, or the like. The distal edges 103 defined by the toothed portions 104, 106 are sloped away and radially inwardly from the middle disc portion 102. Therefore, the teeth 110 will progressively engage the ground during boring operations, depending on how deeply the cutter disc 100 penetrates the ground substrate.

Although in the current embodiment of the cutter disc 100 the teeth 110 of the toothed portions 104, 106 are symmetrical triangular teeth, other tooth shapes are contemplated herein. For example, in an alternative embodiment the teeth 110 are not symmetrical and may be, for example, curved and/or angled to better accommodate a desired rotational direction.

The toothed portions 104, 106 are set back from the outer perimeter or edge 105 of the middle disc portion 102. The outer edge 105 of the middle disc portion 102 defines a continuous narrow surface or edge 105 for engagement with the ground substrate. In this embodiment the cutter edge 105 is disposed a distance C from the toothed portions 104, 106 (the toothed portion setback), as seen most clearly in FIG. 5A. For example the toothed portions 104, 106 may be set back from the cutter edge 105 by at least 10 mm. The toothed portion setback C prevents or minimizes interference by the toothed portions 104, 106 with penetration of the middle disc portion 102 into the ground surface, in rock conditions wherein the disc penetration is low and substantial contact stress is required to achieve penetration. In other exemplary embodiments the cutter edge 105 is disposed a distance of less than 10% of the cutter disc 100 diameter from the toothed portions 104, 106. In another example, the toothed portion setback C is between about 5 mm and 25 mm from the toothed portions 104, 106.

Figure 1:
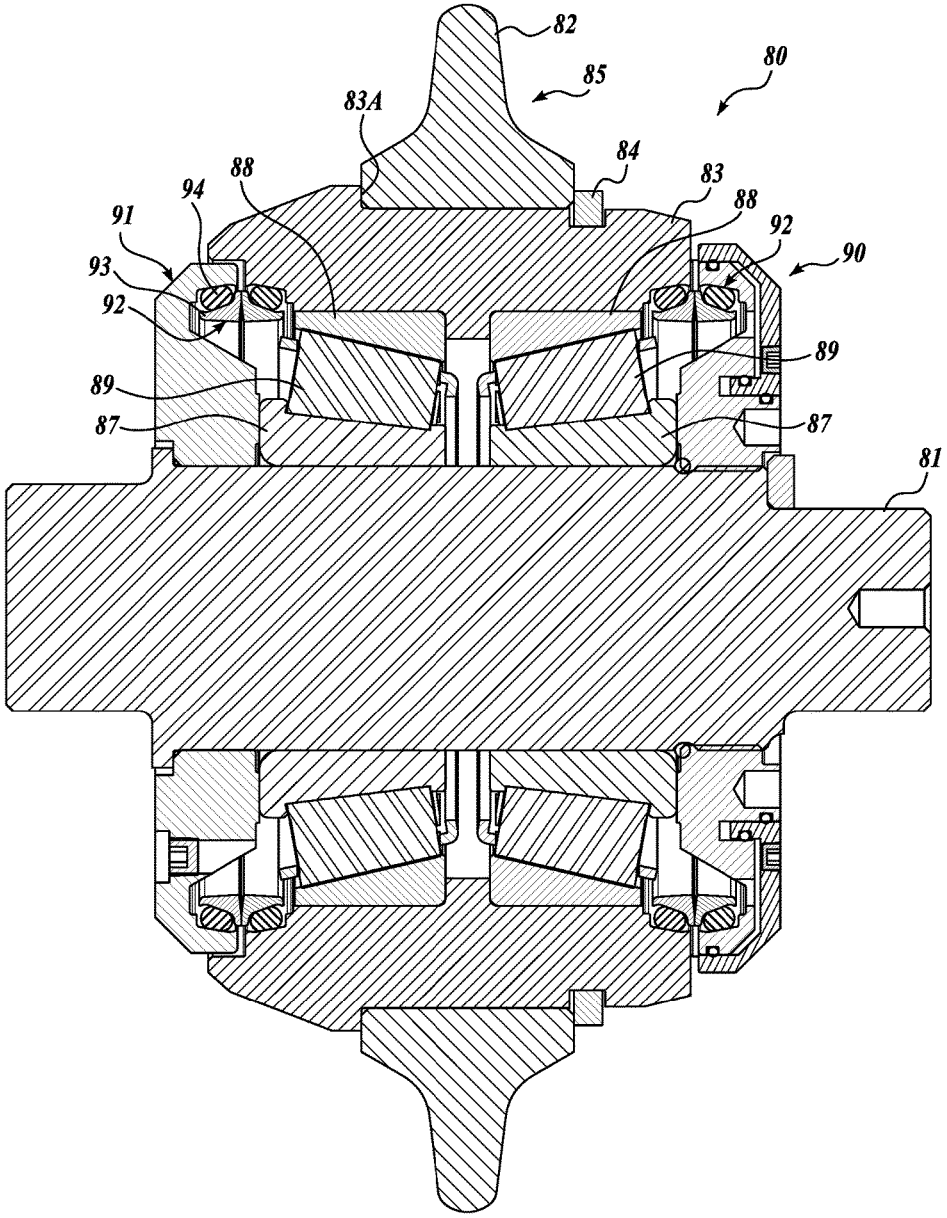
Fig. 1. (PRIOR ART)
FIG. 1 is a cross-sectional front view of a prior art cutter ring assembly with a conventional cutter disc.

FIG. 5A is a sectional view of an exemplary cutter ring assembly 100A with the cutter disc 100 mounted on the hub 83, similar to the assembly shown in FIG. 1. The cutter ring assembly 100 includes a shaft 81 that is configured to be fixedly attached to the TBM rotating cutterhead (not shown). The cutter disc 100 is positioned on the hub 83 between the retainer ring 84 and a shoulder 83A formed in the hub 83, to form the cutter ring assembly 100A.

The radially outermost portion of the middle portion 102 extends a distance C beyond the toothed portions 104, 106.

The middle disc portion 102 in a current embodiment has a width A at its radially outer end (see FIG. 3) that is significantly less than the maximum thickness or width B of the cutter disk 100. For example, the middle disc portion width A is about one-quarter of the cutter disc 102 maximum width B (see FIG. 3). In other embodiments the middle disc portion width A is between one-quarter and one-half the disc width B. For example, the middle disc portion width A may be between 5 mm and 25 mm.

In a current embodiment the cutter disc 100 is mounted on a cylindrical radially outer surface 108 of rotatably mounted hub 83. The cutter disc 100 is fixed to the hub 83 using a thermal interference fit process, in which the cutter disc 100 is heated to a high temperature to thermally expand the cutter disc 100 sufficiently to overcome interference with the cylindrical surface 108 of the hub 83. The cutter disc 100 is then positioned on the hub 83 outer surface 108 against the shoulder 83A and allowed to cool, producing a strong interference fit. The locking ring 84 is then installed.

As seen most clearly in FIG. 3, the left and right toothed portions 104, 106 of the cutter disc 100 may be similar, but rotationally offset from each other. The rotational offset improves the ability of the cutter disc 100 to rotate in nonhomogeneous conditions, and provides a more uniform structural support to the middle portion 102.

Figure 5B:
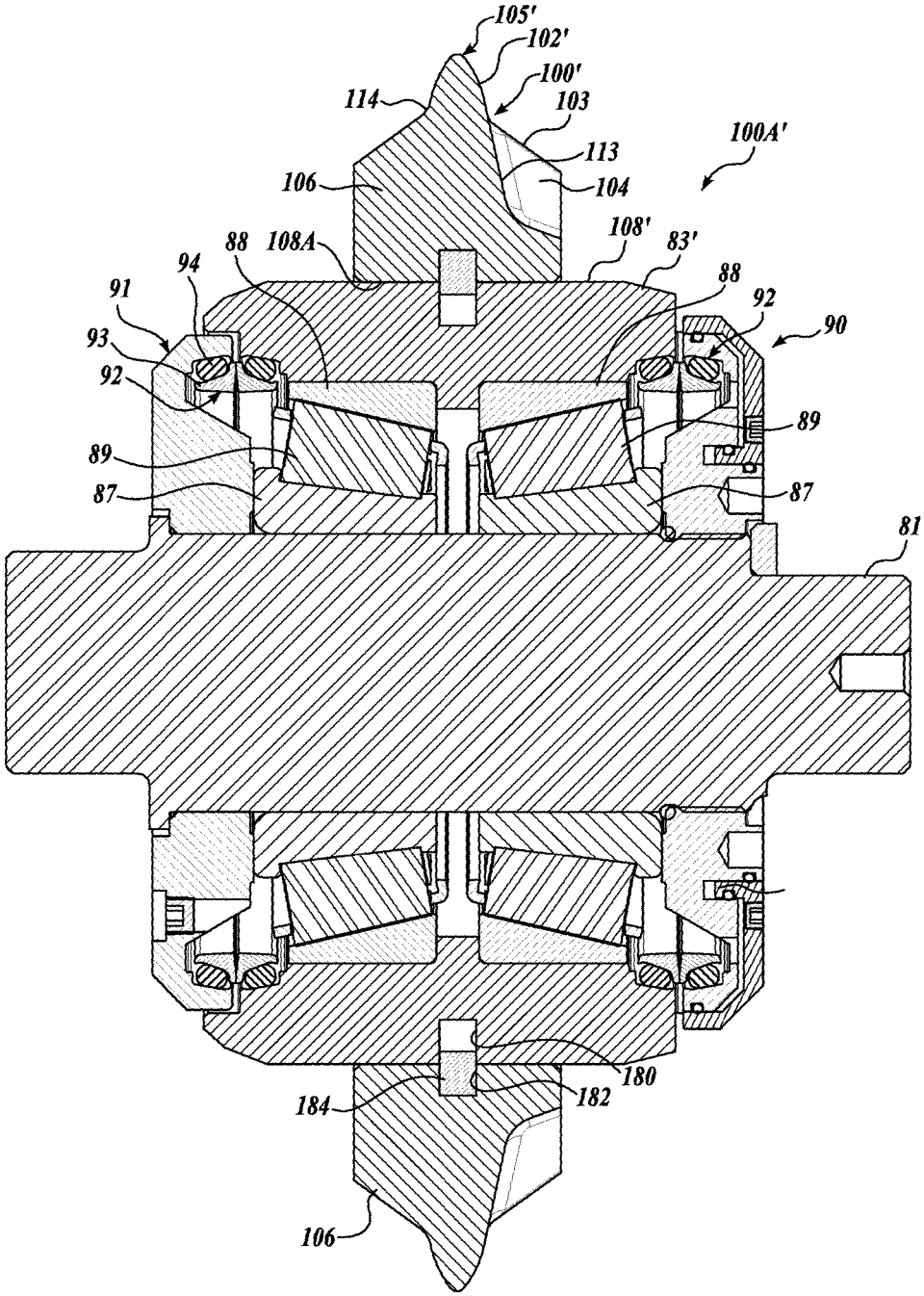
FIG. 5B is a front sectional view of another embodiment of a cutter ring assembly similar to the cutter ring assembly shown in FIG. 5A, wherein the cutter disc is positioned and locked to the hub with a split ring that engages corresponding annular channels in the cutter disc and hub.

FIG. 5B is a cross-sectional view of another embodiment of a cutter ring assembly 100A'. Except as disclosed herein in, the cutter ring assembly 100A' may be similar to the cutter ring assembly 100A disclosed above. In this embodiment the cutter disc 100' has a middle disc portion 102' with a tapered outer edge 105' extending from the sidewalls 113, 114, providing a narrower contact surface. In other embodiments the middle disc portion 102' may have a circular cross-sectional profile. The narrower contact surface increases the stress concentrations applied to the rock face to improve fracturing performance.

In this embodiment the cutter disc 100' also includes an annular channel 180 along the inner surface 108A, and the hub 83' has a corresponding channel 182, that aligns with the annular channel 180 when the cutter disc 100' is positioned properly, such that the channels 182, 180 cooperatively define a closed channel. A split ring 184 is provided in the closed channel. The split ring 184 is compressed into the hub channel 182 while the cutter disc 100' is positioned on the hub 83', and expands into the combined channel when the cutter disc 100' is properly positioned.

As discussed above, it is important for the ring assembly 100A, 100A' to rotate during tunnel boring. In EPB applications relatively soft ground may not provide enough reaction force to rotate a conventional cutter disc. Typically, the hub bearing 89 and group seal 92 assemblies produce about 15 ft-lbs of rolling torque that must be overcome.

When using the cutter ring assembly 100A, 100A' to bore in hard rock the outer edge of the cutter disc 100, 100' is pressed against the hard rock face to promote fracture of the rock face. Preferably the outer edge or surface of the cutter disc 100, 100' is narrow to produce desirable stress concentrations in the rock, and thereby improve rock fracturing. Narrower contact edges will produce greater stress concentration. However, the width of the cutter disc 100, 100' middle portion 102, 102' is limited by the strength required to maintain the integrity of the cutter disc during boring operations. In the cutter disc 100, 100' the toothed portions 104, 106 act as structural gussets to provide support to the middle portion 102, 102' such that the cutter edge 105, 105' may be narrower than would otherwise be required.

A cutter ring assembly operating in relatively soft or mixed earth conditions may penetrate 50 to 80 mm into the softer environments. In hard rock environments the cutter disc 100, 100' may penetrate only to a depth of, for example, 5 mm to 10 mm.

The cutter discs 100, 100' provides advantages for both hard rock boring and in softer or mixed conditions. When operating against hard rock the narrow cutter edge 105 of the middle disc portion 102 engages the rock face with a high contact force (for example, provided by hydraulic cylinders that act to press the cutterhead assembly towards the solid earth) without interference from the toothed portions 104, 106. The high contact force between the cutter disc 100 and the rock face typically ensures the cutter ring assembly 100A will rotate appropriately. The toothed portions 104, 106 provide strength and structural integrity to the middle disc portion 102, enabling a narrower middle disc portion 102 which is more effective for penetrating and cutting hard rock.

In softer soil conditions, the high penetration of the cutter disc 102 into the soil will increase the tangential force required to ensure the cutter disc 102 is able to get a good grip on the ground, to facilitate rotation. However, at higher penetrations the toothed portions 104, 106 progressively engage the earthen material, automatically increasing the rotational forces on the cutter disc 100.

In a current embodiment the cutter disc 100 is fixed to the hub 83 using a thermal interference fit process, in which the cutter disc 100 is heated to high temperatures to thermally expand the cutter disc 100 sufficiently to overcome the interference with the hub 83 (which is not heated). The cutter disc 100 is then positioned on the hub 83 outer surface 108, and allowed to cool, producing a very strong interference fit between the hub 83 and the cutter disc 100. The retainer ring 84 is then installed, to prevent the cutter disc 100 from shifting laterally during use.

Figure 6:
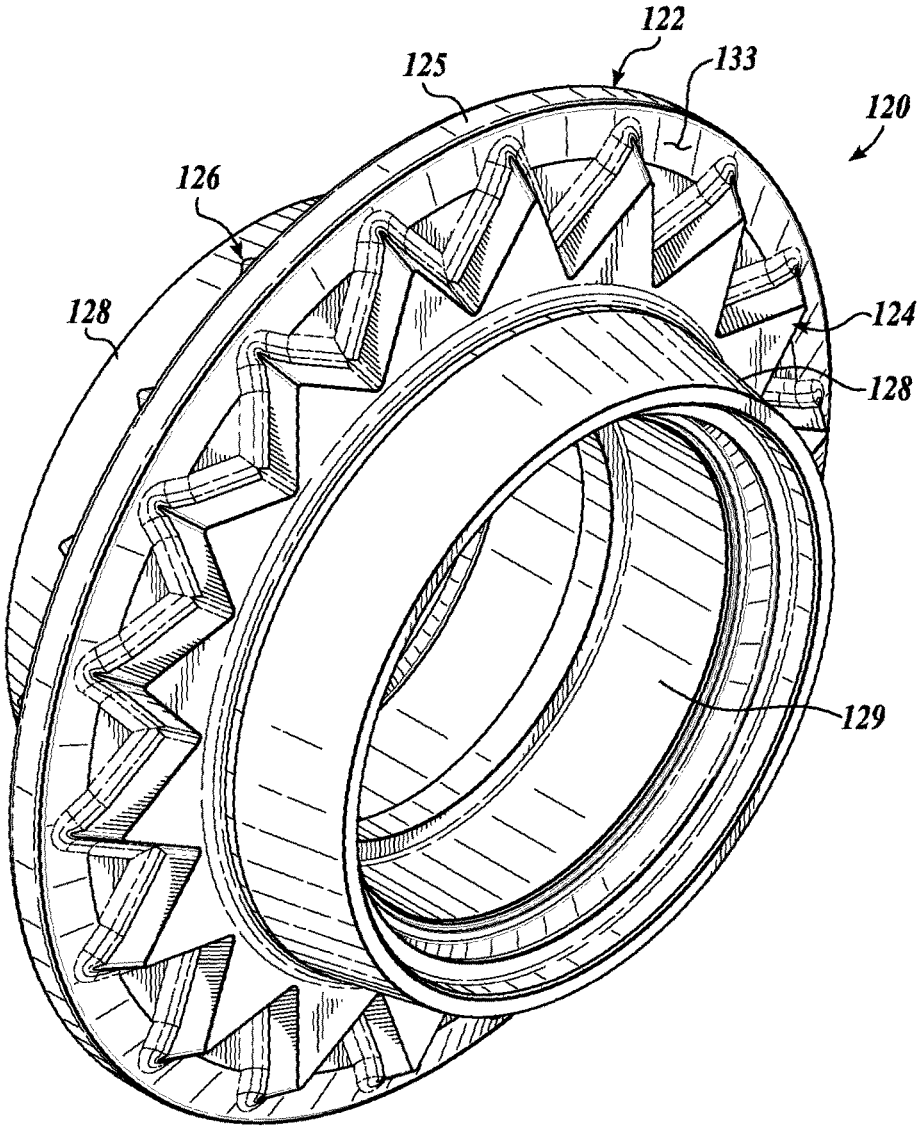
FIG. 6 is a front-right perspective view of a cutter disc with set back teeth and an integral hub in accordance with a second embodiment of the present invention.
Figure 7:
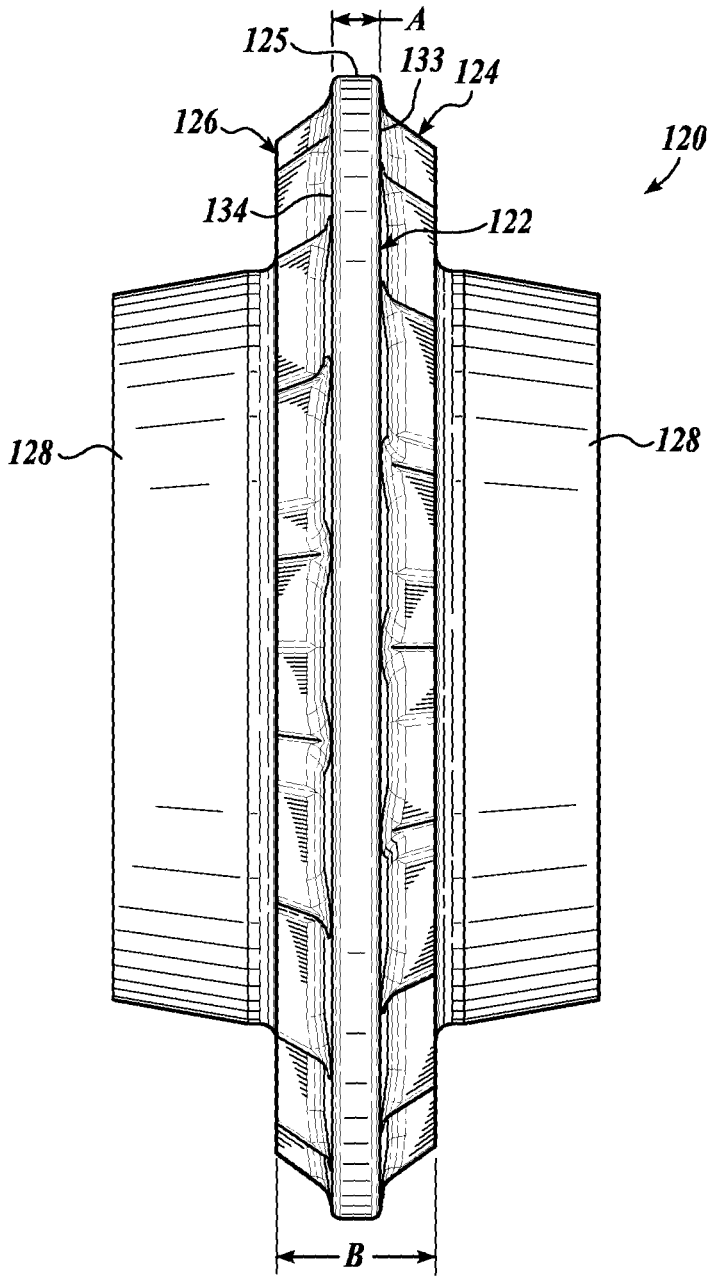
FIG. 7 is a front view of the cutter disc and hub shown in FIG. 6.
Figure 8:
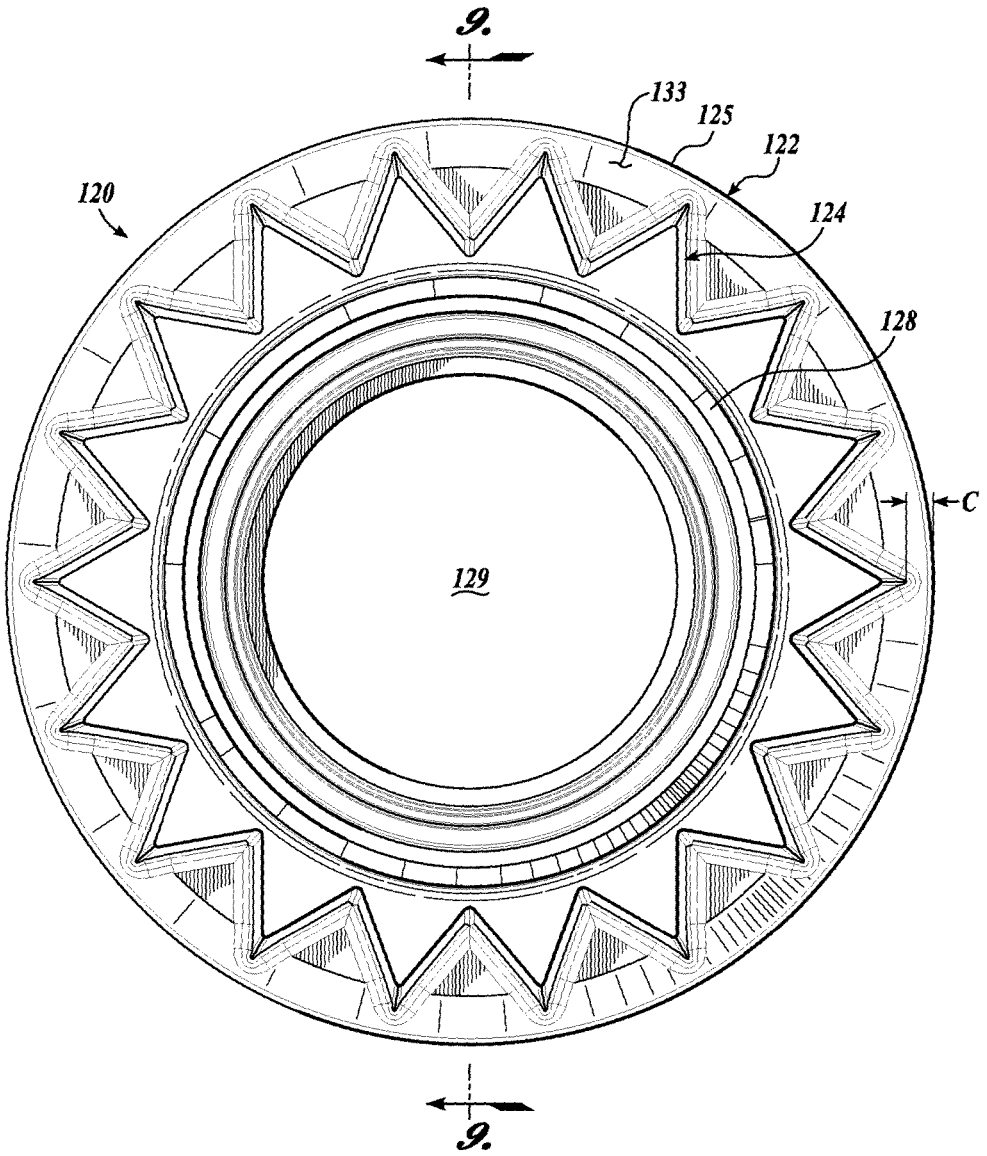
FIG. 8 is a right side view of the cutter disc and hub shown in FIG. 6.
Figure 9:
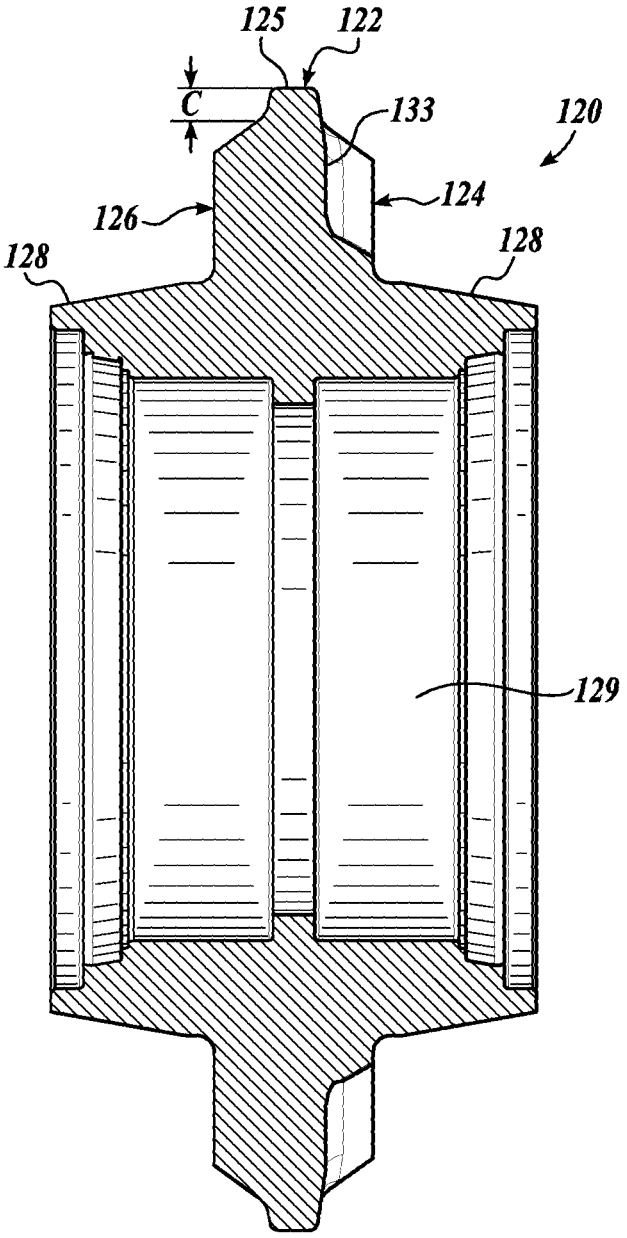
FIG. 9 is a front sectional view of the cutter disc shown in FIG. 6, through Section 9-9 indicated in FIG. 8.

Another embodiment of a cutter disc 120 in accordance with the present invention is shown in FIGS. 6-9. FIG. 6 is a perspective view of the cutter disc 120, FIG. 7 is a front view of the cutter disc 120, FIG. 8 is a right side view of the cutter disc 120, and FIG. 9 is a sectional view of the cutter disc 120. In this embodiment the cutter disc 120 includes integrally formed hub portions 128. The cutter disc 120 is otherwise similar to the cutter disc 100 described above.

The cutter disc 120 includes a middle disc portion 122 having side walls 133, 134 defining a radially outward rock-engagement surface or edge 125, a right toothed portion 124 and a left toothed portion 126. The right and left toothed portions 124 and 126 are set back radially from the rock engagement surface 125 by a setback distance C. The toothed portions 124, 126 are configured (i) to provide structural support for the middle disc portion 122, (ii) to facilitate rotation of the cutter disc 120 during tunnel boring operations, particularly when boring is EPB or mixed conditions, and (iii) to not interfere with engagement of the rock-engagement surface 125 when boring in hard rock conditions.

The hub portions 128 are integrally formed with the cutter disc 120, and extend axially from the corresponding right and left toothed portions 124, 126. A central bore 129 is shaped to accommodate bearing, seal, and retainer assemblies for rotatably supporting the cutter disc 120 on a shaft, for example, substantially as shown in FIG. 5A.

In a particular embodiment the cutter discs 100, 120 are manufactured as a tool steel forging, for example a martensitic tool steel, providing a desired hardness, resistance to abrasion and deformation, and tolerance to high temperatures. This robust construction is particularly suited to handle loads during boulder fracturing.

The cutter discs 100, 100', 120 provide a combination of cutting characteristics not found in prior art cutter discs, including (i) efficient operation at high penetration in mixed soil conditions known to cause extreme wear on prior art carbide insert discs, (ii) high contact stress concentration in hard rock to maximize penetration where true rolling and reduced contact area are desirable, (iii) continuous disc rotation during tunnel boring in varied ground conditions from rock face to earth pressure balance conditions, and (iv) improved uniformity in disc wear.

While illustrative embodiments have been illustrated and described, it will be appreciated that various changes can be made therein without departing from the spirit and scope of the invention.

The embodiments of the invention in which an exclusive property or privilege is claimed are defined as follows:

1. A cutter disc for a cutter ring assembly for a tunnel boring machine comprises:

a tool steel forging having three integral portions comprising:

a middle disc portion having a first sidewall, a second sidewall, and a radially outer continuous cutter edge portion joining the first sidewall and the second sidewall;

a first annular toothed portion extending from the first sidewall and defining a first plurality of teeth that are set back from the continuous cutter edge portion of the middle disc portion, wherein the first plurality of teeth define distal edges that slope away from the first sidewall and radially inwardly; and a second annular toothed portion extending from the second sidewall and defining a second plurality of teeth that are set back from the continuous cutter edge portion of the middle disc portion, wherein the second plurality of teeth define distal edges that slope away from the second sidewall and radially inwardly.

2. The cutter disc of claim 1, wherein the first and second plurality of teeth are triangular teeth.

3. The cutter disc of claim 2, wherein the first plurality of teeth comprises at least eighteen teeth.

4. The cutter disc of claim 1, wherein the first plurality of teeth are spaced apart.

5. The cutter disc of claim 1, wherein the first and second plurality of teeth each define a radially outer edge that slopes away from the continuous cutter edge portion, such that when the cutter disc penetrates into ground an engagement of the first and second plurality of teeth with the ground will increase with a depth of the penetration.

6. The cutter disc of claim 5, wherein the first plurality of teeth are circularly arranged and uniformly spaced, and the second plurality of teeth are circularly arranged and uniformly spaced, and the first plurality of teeth are circumferentially offset from the second plurality of teeth.

7. The cutter disc of claim 1, wherein the first annular toothed portion is thicker than the continuous cutter edge portion of the middle disc portion.

8. The cutter disc of claim 1, wherein the first and second plurality of teeth are set back from the continuous cutter edge portion by between 5 mm and 25 mm.

9. The cutter disc of claim 1, further comprising a first integral hub portion extending axially from the first annular toothed portion, and a second integral hub portion extending axially from the second annular toothed portion.

10. The cutter disc of claim 1, wherein the cutter disc further comprises a circular annular channel along an inner surface that is sized and configured to receive a split locking ring for locking the cutter disc to a cutter ring assembly hub.

11. A cutter ring assembly for a tunnel boring machine comprising:

a hub;

a cutter disc mounted on the hub, the cutter disc comprising a tool steel forging having three integral portions comprising: (i) a middle disc portion having a first sidewall, a second sidewall, and a radially outer continuous cutter edge portion joining the first sidewall and the second sidewall, (ii) a first annular toothed portion extending from the first sidewall and defining a first plurality of teeth that are set back from the continuous cutter edge portion of the middle disc portion, wherein the first plurality of teeth define distal edges that slope away from the first sidewall and radially inwardly, and (iii) a second annular toothed portion extending from the second sidewall and defining a second plurality of teeth that are set back from the continuous cutter edge portion of the middle disc portion, wherein the second plurality of teeth define distal edges that slope away from the second sidewall and radially inwardly;

a bearing assembly mounted in the hub and comprising an inner bearing race, an outer bearing race, and a plurality of roller bearings rotatably retained by the inner and outer bearing races;

a shaft fixed to the inner bearing race;

a first retainer and a second retainer, each retainer fixed to the shaft, wherein the first and second retainers are disposed on opposite ends of the hub and enclose the bearing assembly there between; and a first rotary seal group configured to sealingly engage the hub and the first retainer, and a second rotary seal group configured to sealingly engage the hub and the second retainer, whereby the hub and cutter disc are rotatably supported on the shaft.

12. The cutter ring assembly of claim 11, wherein the first and second plurality of teeth are triangular teeth.

13. The cutter ring assembly of claim 12, wherein the first plurality of teeth comprises at least eighteen teeth.

14. The cutter ring assembly of claim 11, wherein the first and second plurality of teeth are spaced apart.

15. The cutter ring assembly of claim 11, wherein the first and second plurality of teeth each define a radially outer edge that slopes away from the continuous cutter edge portion, such that when the cutter disc penetrates into ground an engagement of the first and second plurality of teeth with the ground will increase with a depth of the penetration.

16. The cutter ring assembly of claim 11, wherein the first plurality of teeth are circularly arranged and uniformly spaced, and the second plurality of teeth are circularly arranged and uniformly spaced and the first plurality of teeth are circumferentially offset from the second plurality of teeth.

17. The cutter ring assembly of claim 11, wherein the first annular toothed portion is thicker than the continuous cutter edge portion of the middle disc portion.

18. The cutter ring assembly of claim 11, wherein the first and second plurality of teeth are set back from the continuous cutter edge portion by between 5 mm and 25 mm.

19. The cutter ring assembly of claim 11, wherein the cutter disc is securely mounted to the hub with an interference fit.

20. The cutter ring assembly of claim 11, wherein the cutter disc has a circular annular first channel along an inner surface and the hub has a corresponding outer second channel along an outer surface, and further comprising a split locking ring sized to be compressed into one of the first channel and the second channel, and configured to expand lock the cutter disc to the hub.

* * * * *